US007830274B2

(12) United States Patent
Kolb

(10) Patent No.: US 7,830,274 B2
(45) Date of Patent: Nov. 9, 2010

(54) METHOD AND DEVICE FOR IMPROVING TRAFFIC SAFETY

(75) Inventor: Dieter Kolb, Germering (DE)

(73) Assignee: Siemens Aktiengesellschaft, Munich (DE)

( * ) Notice: Subject to any disclaimer, the term of this patent is extended or adjusted under 35 U.S.C. 154(b) by 281 days.

(21) Appl. No.: 12/068,895

(22) Filed: Feb. 13, 2008

(65) Prior Publication Data

US 2008/0191902 A1 Aug. 14, 2008

(30) Foreign Application Priority Data

Feb. 14, 2007 (DE) ..... 10 2007 007 346

(51) Int. Cl.
*G08G 1/09* (2006.01)

(52) U.S. Cl. ..... 340/905; 340/903; 701/117; 701/209

(58) Field of Classification Search ..... 340/905, 340/903, 993; 701/117, 207, 209, 210
See application file for complete search history.

(56) References Cited

U.S. PATENT DOCUMENTS

| | | | | |
|---|---|---|---|---|
| 5,270,708 | A * | 12/1993 | Kamishima | 340/905 |
| 5,867,804 | A | 2/1999 | Pilley | |
| 6,133,867 | A | 10/2000 | Eberwine et al. | |
| 6,161,063 | A | 12/2000 | Deker | |
| 6,282,492 | B1 * | 8/2001 | Gorai et al. | 701/209 |
| 6,317,682 | B1 * | 11/2001 | Ogura et al. | 701/117 |
| 6,459,365 | B2 * | 10/2002 | Tamura | 340/903 |
| 6,484,092 | B2 * | 11/2002 | Seibel | 701/209 |
| 6,700,504 | B1 | 3/2004 | Aslandogan | |
| 7,330,780 | B2 | 2/2008 | Von Viebahn et al. | |
| 2002/0121989 | A1 | 9/2002 | Burns | |

FOREIGN PATENT DOCUMENTS

| | | | |
|---|---|---|---|
| EP | 0904574 | A1 | 3/1999 |
| WO | WO03088181 | A1 | 10/2003 |

OTHER PUBLICATIONS

Internet: http://www.siemens.com/index.jsp?sdc_p=cfi103168510mno1262263ps5uz3&sdc_bcpath=1327899.s_5%2C1034230.s_5%2C1031937.s_5%2C&isdc_sid=23466753061&). Virtuelle Verkehrszeichen; Feb. 14, 2007

Internet: http://www.siemens.com/index.jsp?sdc_p=cfi103168510mno1241443ps5uz3&sdc_bcpath=1327899.s_5%2C1034230.$s_{13}$ 5%2C1031937.s_5%2C&sdc_sid=510140024&) "Unsichtbare Haftnotizen"; Feb. 14, 2007=http://www.siemens.com/index.jsp?sdc_p=i1243310lmn1184811o1243310pFEcfsu20z1&sdc_sid=3129607481 9& Invisible Post-Its.

European Search Report for EP08100967 dated May 9, 2008.

* cited by examiner

*Primary Examiner*—John A Tweel, Jr.
(74) *Attorney, Agent, or Firm*—Harness, Dickey & Pierce, P.L.C.

(57) ABSTRACT

An embodiment of the present invention improves traffic safety in the field of aviation and in the field of shipping, and also in road traffic. In at least one embodiment, a method achieves this by determining at specified intervals a current position and a current direction, retrieving geographical description data for at least one exclusion zone or one danger area from a control center and from this data, by way of a warning condition, issuing at least one warning message, provided the warning condition has been fulfilled. In at least one embodiment, the warning condition is selected in such a way that intrusion into the at least one exclusion zone or one danger area can be securely prevented by way of an appropriate counter maneuver.

16 Claims, 4 Drawing Sheets

METHOD AND DEVICE FOR IMPROVING TRAFFIC SAFETY

PRIORITY STATEMENT

The present application hereby claims priority under 35 U.S.C. §119 on German patent application number DE 10 2007 007 346.3 filed Feb. 14, 2007, the entire contents of which is hereby incorporated herein by reference.

FIELD

Embodiments of the present application generally relate to methods and/or devices for improving traffic.

BACKGROUND

In air traffic, dangerous situations are constantly arising, by airplanes unintentionally approaching military exclusion zones or approaching corridors of airports, for example. This in particular applies to airplanes of the general area of aviation, which are not subject to monitoring by air traffic controllers. Because traffic signs cannot be fitted in the air, as per road traffic, maps with the indications drawn thereon are, at present, the only source of information for pilots. However, maps only enable a 2D display. Some exclusion zones such as for example approach paths are only applicable at certain heights; flying is permitted above such zones and also below them.

A similar situation is encountered in the field of shipping navigation. Here, traffic signs can only be implemented as buoys away from the shore. Apart from that, only the map remains here as a source of information.

Evidence that "virtual traffic signs" make driving a motor vehicle safer is for example known from the publication http://www.siemens.com/index.jsp?sdcp=cfi103168510mno1262263ps5uz3&sdcbcpath=1327899.s 5%2C1034230.s 5%2C1031937.s 5%2C&sdc sid=23466753061&). This known concept makes provision, as a supplement to existing information signs and control systems, for the transmission of individual information to the driver of the motor vehicle by superimposing the information on the windshield, such as information about the current speed limit or short-term construction zones or accidents for example. The cellular phone network or the DVB (Digital Video Broadcast) can be used as a transmission medium from central traffic management to the motor vehicle.

In addition, a method of displaying information to individual users as soon as they approach a specific position assigned to this information is for example known from the publication http://www.siemens.com/index.jsp?sdcp=cfi103168510mno1241443ps5uz3&sdcbcpath=1327899.s 5%2C1034230.s 5%2C1031937.s 5%2C&sdc sid=510140024&).

SUMMARY

In at least one embodiment, the present invention provides a method and/or a device for improving traffic safety in the field of aviation and in the field of shipping navigation and also in road traffic.

An idea behind at least one embodiment of the present invention lies in improving traffic safety in the field of aviation and in the field of shipping, but also in road traffic, by determining at specified intervals a current position and a current direction, retrieving geographical description data for at least one exclusion zone or one danger area from a control center and from this data, by way of a warning condition, issuing at least one warning message, provided the warning condition has been fulfilled, with the warning condition being selected in such a way that intrusion into the at least one exclusion zone or one danger area can be securely prevented by means of an appropriate counter maneuver.

BRIEF DESCRIPTION OF THE DRAWINGS

The invention is described in more detail below with reference to the example embodiments specified in the schematic figures of the drawings, in which.

DETAILED DESCRIPTION OF THE EXAMPLE EMBODIMENTS

Figure 1:
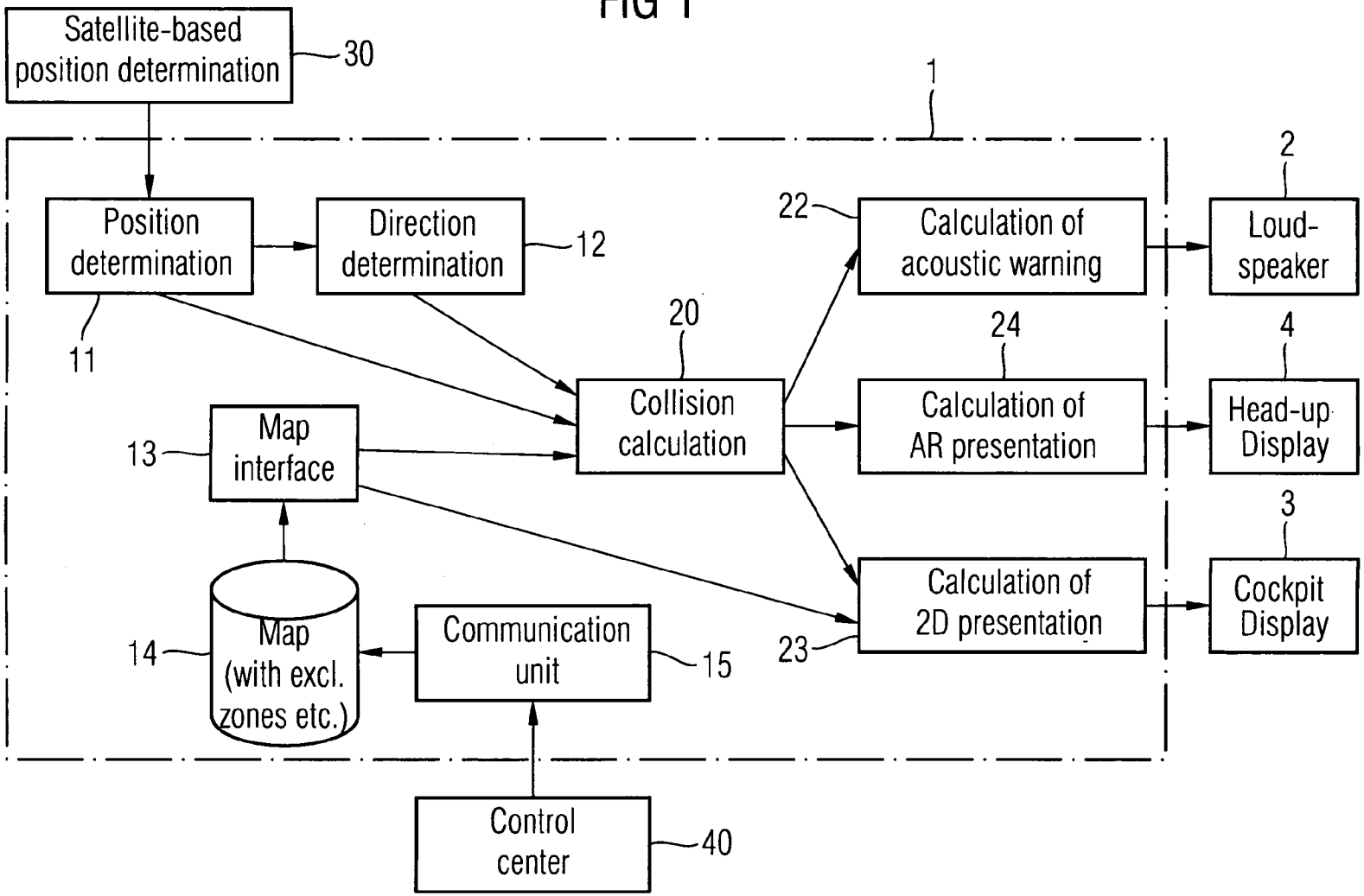
FIG. 1 shows a diagram to explain an embodiment of the invention in relation to airplanes and ships.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

Airplane

FIG. 1 shows a inventive device 1 that can be fitted in an airplane, which constantly determines the current position 11 of the airplane via a satellite-based position determination system 30, such as for example GPS. The current direction of flight 12 is determined from the values of consecutive position determinations.

The device 1 in accordance with an embodiment of the invention contains at least one digital map 14 of the area to be overflown, on which the current exclusion zones or danger areas are marked.

Before take-off and as an option, if required, also during the flight, the device 1 receives from a control center 40 information about exclusion zones or danger areas that have been set up temporarily or for the short term, which are located in the vicinity of its planned flight path. This can for example be an overflight ban because of an event. This update for example is undertaken using a mobile radio telephone service, for example, GSM/GPRS or UMTS or other wireless communication methods such as WLAN or WiMAX. To this end, device 1 is equipped with a communication unit 15.

In an example embodiment of the invention, a topographic map or a flight map with the current surrounding area of the airplane is shown on a display 3 in the cockpit of the airplane. The current positioning and orientation of the airplane is shown on the map. The current exclusion zones or danger areas are likewise drawn on the map. The pilot has the option of selecting the scale of the map section shown in each case.

During the flight, a component for collision calculation 20 constantly checks the danger of a possible intrusion into an exclusion zone by using the information about the current position 11 of the airplane and the current direction 12 of the airplane as well as the topography of the terrain and the position of the exclusion zones from a map interface 13 or the map 14.

If the airplane approaches an exclusion zone during the flight, device 1 automatically draws attention to the situation by means of an acoustic signal, without communication with a control center or another monitoring station being necessary outside the airplane. For the acoustic signal, an acoustic warning 22 is compiled and output via a loudspeaker 2 in the cockpit. In addition, a corresponding warning message 23 is included in the representation of a map and output on the display 3 in the cockpit.

As an option, the warning message is also superimposed by projection by way of a head-up-display 4 on the front windshield of the cockpit of the airplane. In this process, the three-dimensional exclusion zone is displayed 24 with methods of the augmented reality in such a way on the front windshield that, as the pilot sees it, it appears to be fit perfectly into the landscape which appears to the pilot through the front windshield. In addition, the distance to the exclusion zone and, for flying over or flying under the zone, the estimated height above or below the exclusion zone is displayed in text form.

As an option, the warning messages 23 become more intense if the airplane continues to approach the exclusion zone and would intrude into the exclusion zone were it to keep to its current course.

If the airplane has already penetrated the exclusion zone, suitable messages are issued and displayed as an option to enable it to leave the exclusion zone as quickly as possible and without further dangers.

During the flight, the pilot can for example receive by radio individual instructions of an air traffic controller from the control center 40, in order to for example adopt a specific flying height or to veer off in a specific direction. These instructions are converted by device 1 into corresponding maneuver instructions, such as for example "descend to 500 meters", "course 185" and the like, the implementation of which is monitored and comments such as for example "target height reached" or the like are added.

In addition, in the case of airplanes without autopilot, this method can also be used in order to monitor the adherence to a planned flight path and flying height or to an assigned flight path and flying height and to transmit correcting instructions.

Ship

A similar application of this method is possible in the field of shipping navigation: the current position and direction of the ship are determined all the time. The current position and orientation of the ship is displayed on a display in a maritime map. The coast formation, exclusion zones, obstacles and shoals are noted on the map. In addition, the system knows the current draft of the ship depending on the load.

Information about exclusion zones that have been set up temporarily or for the short term or obstacles, such as for example exclusion zones because of a regatta or due to an accident along the planned route, are transmitted by radio to the ship before the departure thereof or, if required, even during the ship's voyage.

If the ship approaches a point at which it could sustain damage because of its current draft and the current external conditions such as, for example, tides, wave height and wind, a corresponding warning message will automatically be issued: acoustically, by way of a text message on a display and by indicating the danger spot on the map.

Road Vehicle

Figure 2:
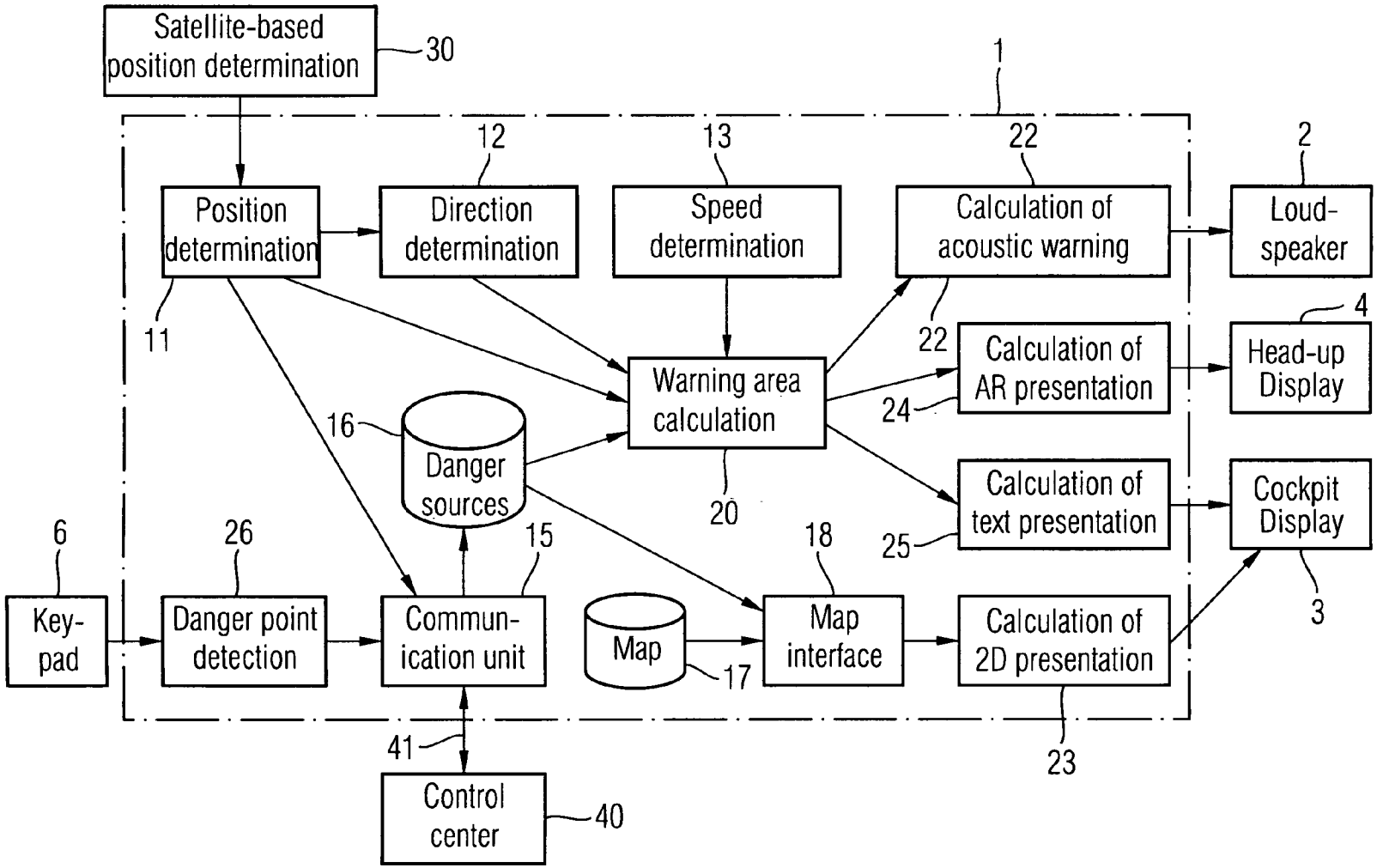
FIG. 2 shows a diagram to explain an embodiment of the invention in relation to road vehicles.

In road traffic, this method warns the driver of a vehicle of dangers and problems such as, for example, danger of black ice, of traffic congestion at a particular point, of temporary construction zones and speed limits. This is explained in more detail below by way of FIG. 2.

An embodiment of the invention is implemented in a similar way to that described above. Device 1 sends, at specified intervals, its current position to the control system 40, which for example takes place after each kilometer covered or more frequently in the inner-city area than for example on the freeway.

Figure 3:
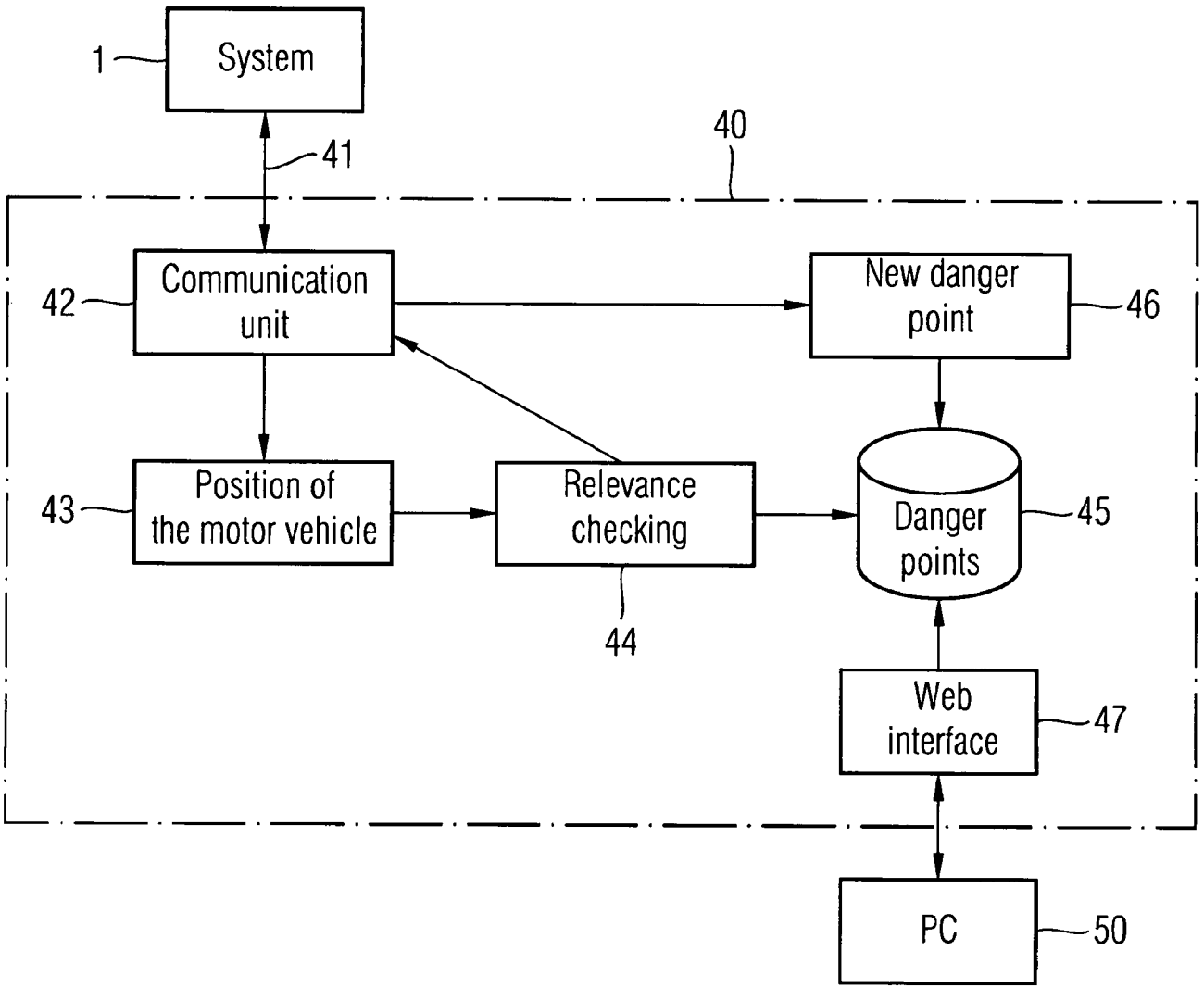
FIG. 3 shows a diagram to explain the control system in the case of road vehicles and FIG. 4 shows a diagram to explain the issuing of warnings in the case of road vehicles.

The control system 40 shown in more detail in FIG. 3, in this case knows the danger spots or danger areas in its area of responsibility. They are thus stored in a danger spot memory 45 of the control system. The danger spots or the danger areas are assigned to a geographical location. They can cover a certain area. They can for example in the case of traffic congestion confine themselves to a direction of travel of the road.

If the control system 40 receives a position message 43 of a vehicle via a communication interface 41, it performs a check in a relevance test component 44 as to whether danger spots are contained in its danger spot memory 45 in the vicinity of the position. If this is the case, corresponding information is sent via the communication connection 41 to the device 1 in the vehicle and stored there.

The device 1 in the vehicle also constantly determines its current position and speed. Hence, when it further approaches the locally stored danger spot, this is identified by way of component 20 and an acoustic warning 22 is issued and output via the loudspeaker 2 to the driver of the vehicle. As an option, this warning can also at the same time be issued in text form or in a graphical form 25 and displayed on a display in the cockpit 3 or on the display of a navigation system that may be provided. As an option, this warning can also be superimposed by projection by means of a head-up-display 4 on the front windshield of the vehicle.

If the vehicle has a navigation system with a representation of a map, the danger spot can be displayed on the map as an option as soon as they have been transferred from the control system 40 to the device 1 in the vehicle.

If there are no other or no more danger spots because the traffic congestion has for example resolved itself, the control center 40 sends a corresponding message to the device 1 in the vehicle. The message that contains an indication of the danger spot is then canceled on the representation of a map and a warning is then no longer issued to the driver of the vehicle when the driver approaches the danger spot.

If the driver of a vehicle discovers a danger spot, which is not yet known in the control system, the driver can detect this as an option with the detection component 26 via an input medium 6 and inform the control system 40 via the communication connection 41.

In addition, information about danger spots can as an option be created on a PC 50 with the aid of the Web interface 47 and stored in the danger spot memory 45. Information about danger spots can be modified in or deleted from the danger spot memory in the same way.

Figure 4:
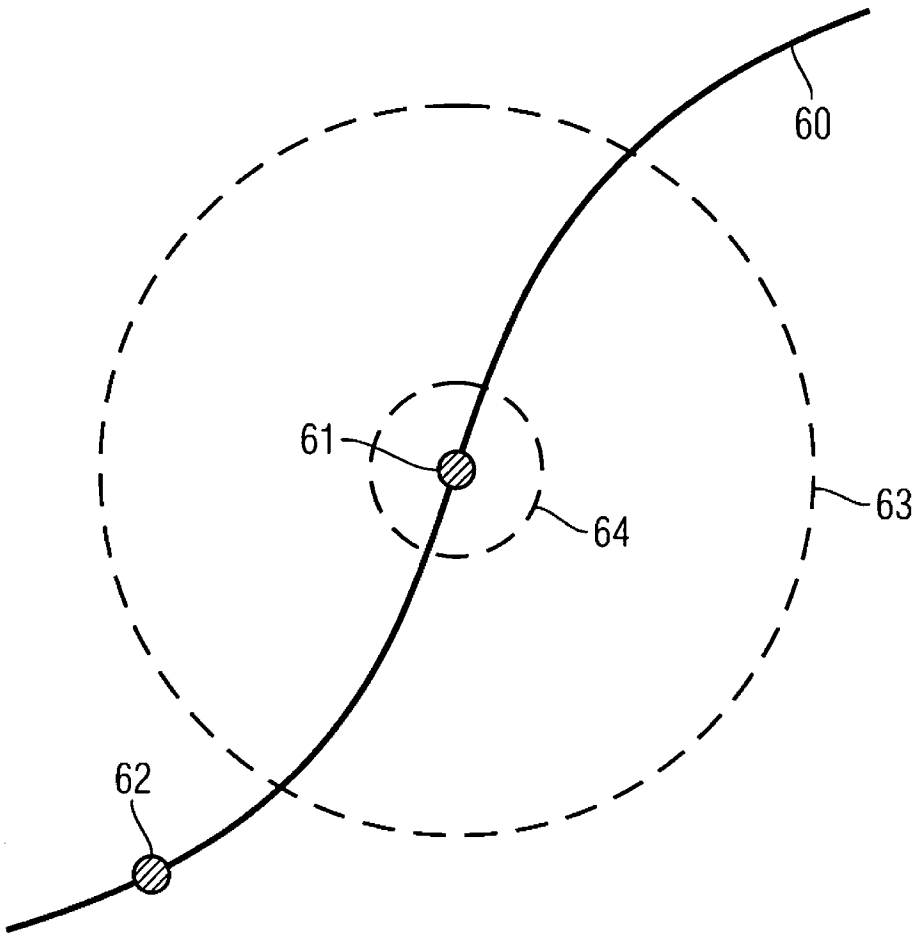

FIG. 4 shows when the information about a danger spot is transmitted to the device 1 and when the warning is issued. In this case, on a road 60 there has for example been an accident at a point 61. A vehicle at the position 62 approaches the scene of the accident. The vehicle sends at a specified interval, for example every kilometer, its current position to the control system 40. As soon as the vehicle transmits a position to the control system for the first time which lies on an outer circle 63, the so-called transmission radius, the information about the accident is transmitted from the control system 40 to the device 1. Furthermore, the vehicle constantly determines, i.e. for example at intervals in seconds, its current position. As soon as it determines a position which lies on an inner circle 64, the so-called display radius, the message will be issued.

The distance between the actual danger spot and that point at which the driver of the vehicle is warned is speed-dependent; in the case of a high driving speed, for example on the freeway, the warning is already issued at a greater interval before the danger spot than in the urban area.

In addition to information about danger spots, the control system can also manage any other location-related information and transmit this in a time- and situation-related manner to the device 1.

With this solution, the drivers of vehicles can be warned of dangers in good time and in an accurate manner. The warning is considerably more helpful than that of a radio broadcasting message such as for example "Accident on freeway A . . . between junctions B . . . and C . . . . The tail end of the traffic congestion is around a bend."

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for improving traffic safety for a transport device, comprising:

determining at least one current position and one current direction at specified intervals in the transport device;

retrieving geographical description data for at least one exclusion zone or danger area from a control center via a communication unit;

performing at least one of a collision calculation or a calculation of the alert zone for the at least one exclusion zone or danger area based on the determining and the retrieving; and issuing at least one warning message upon a warning condition being fulfilled, the warning condition being selected to prevent intrusion into the at least one exclusion zone or danger area by way of a counter maneuver, wherein a radius of an inner circle belonging to the at least one exclusion zone or danger area is determined as a function of speed of the transport device.

2. The method as claimed in claim 1, wherein description data for the at least one exclusion zone danger area is currently retrieved at specified intervals.

3. The method as claimed in claim 1, wherein, the transport device sends the current position to the control center at specified intervals and, as soon as a position lying within a specified outer circle belonging to the at least one exclusion zone or to danger area is transmitted for the first time to the control center, the information is transmitted back about the at least one exclusion zone or danger area from the control center to the transport device, and the transport device constantly continues determining the current position and, as a position is determined which lies on the inner circle, the warning message is issued.

4. The method as claimed in claim 3, wherein the at least one warning message contains instructions for the counter maneuver.

5. The method as claimed in claim 1, wherein a relatively greater radius of the inner circle is determined for a relatively faster speed of the transport device, and a relatively smaller radius of the inner circle is determined for a relatively slower speed of the transport device.

6. The method as claimed in claim 1, wherein the at least one warning message becomes more intense if an appropriate counter maneuver is not initiated.

7. The method as claimed in claim 1, wherein a relatively greater radius of the inner circle is determined for a relatively faster speed of the transport device, and a relatively smaller radius of the inner circle is determined for a relatively slower speed of the transport device.

8. The method as claimed in claim 2, wherein the at least one warning message becomes more intense if an appropriate counter maneuver is not initiated.

9. The method as claimed in claim 1, wherein a relatively greater radius of the inner circle is determined for a relatively faster speed of the transport device, and a relatively smaller radius of the inner circle is determined for a relatively slower speed of the transport device.

10. The method as claimed in claim 3, wherein the at least one warning message becomes more intense if an appropriate counter maneuver is not initiated.

11. The method as claimed in claim 1, wherein a relatively greater radius of the inner circle is determined for a relatively faster speed of the transport device, and a relatively smaller radius of the inner circle is determined for a relatively slower speed of the transport device.

12. The method as claimed in claim 4, wherein the at least one warning message becomes more intense if an appropriate counter maneuver is not initiated.

13. A device for improving traffic safety of a transport device, comprising:

a navigation unit configured to determine a current position and a current direction at specified intervals;

a communication unit configured to retrieve geographical description data for at least one exclusion zone or danger area from a control center; and a collision unit configured to perform a collision calculation and configured to issue a warning message based upon the determined position, the determined direction and the retrieved geographical description data for the at least one exclusion zone or danger area, upon a warning condition being fulfilled, wherein a radius of an inner circle belonging to the at least one exclusion zone or danger area is determined as a function of speed of the transport device.

14. The device of claim 13, wherein the warning condition is such that intrusion into the at least one exclusion zone or danger area is preventable by way of an appropriate counter maneuver.

15. A device for improving traffic safety of a transport device, comprising:

means for determining a current position and a current direction at specified intervals;

means for retrieving geographical description data for at least one exclusion zone or danger area from a control center; and means for issuing a warning message based upon the determined position, the determined direction and the retrieved geographical description data for the at least one exclusion zone or danger area, upon a warning condition being fulfilled, wherein a radius of an inner circle belonging to the at least one exclusion zone or danger area is determined as a function of speed of the transport device.

16. The device of claim 15, wherein the warning condition is such that intrusion into the at least one exclusion zone or danger area is preventable by way of an appropriate counter maneuver.

* * * * *